US006210105B1

(12) United States Patent
Irish

(10) Patent No.: US 6,210,105 B1
(45) Date of Patent: Apr. 3, 2001

(54) FLOW DIRECTING DEVICE FOR A MEDIUM CONSISTENCY PUMP

(75) Inventor: Herbert Addison Irish, Mobile, AL (US)

(73) Assignee: Irish & Asssociates, Mobile, AL (US)

( * ) Notice: Subject to any disclaimer, the term of this patent is extended or adjusted under 35 U.S.C. 154(b) by 0 days.

(21) Appl. No.: 09/200,702

(22) Filed: Nov. 27, 1998

(51) Int. Cl.[7] ..... F04D 1/10

(52) U.S. Cl. ..... 415/143; 415/169.1; 415/62; 415/121.1; 415/66

(58) Field of Search ..... 415/143, 121.1, 415/121.2, 62, 66, 67, 208.1

(56) References Cited

U.S. PATENT DOCUMENTS

| | | | | |
|---|---|---|---|---|
| 4,275,988 | | 6/1981 | Kalashnikov et al. . | |
| 4,770,604 | * | 9/1988 | Luthi et al. | 415/143 |
| 4,776,753 | * | 10/1988 | Weinrib | 415/120 |

FOREIGN PATENT DOCUMENTS

| | | |
|---|---|---|
| 1 190 437 | 4/1965 | (DE) . |
| 1 683 864 | 3/1971 | (DE) . |
| D3 33 40 858 A1 | 5/1984 | (DE) . |
| 0 297 464 | 1/1989 | (EP) . |
| 0 409 456 AZ | 1/1991 | (EP) . |
| 0 600 820 A1 | 6/1994 | (EP) . |
| 1 523 893 | 9/1978 | (GB) . |

OTHER PUBLICATIONS

Patent Abstracts of Japan, vol. 013, No. 169 (C–587), Apr. 21, 1989 & JP 63 317594 A (Hitachi Ltd., others: 01), abstract.

* cited by examiner

*Primary Examiner*—Edward K. Look
*Assistant Examiner*—Richard Woo
(74) *Attorney, Agent, or Firm*—Oliff & Berridge, PLC

(57) ABSTRACT

A flow directing device, system and method for delivery and pumping medium to high consistency stock slurries eliminates bridging of stock, creates a non-vortexing improved flow into the pump suction of a pump, is independent from pump operation, minimizes "slip/stick", and does not mix air into the pulp fibers. The flow directing device is a low-speed, mechanical device including a two-stage turbine, a turbine shaft, a turbine mounting adapter, a gear reducer and an electric motor. The device is used with a dropleg to assist flow of medium to high consistency suspensions (pulp) to the pump, preferably a rotary pump. The flow directing device is operated independently from the pump. The flow directing device and pump work in concert with each other to form a stock pumping system capable of handling paper stock consistencies from 8–18% without the problems associated with other types of pumping systems. This is achieved by first liberating liquid from the stock slurry by providing a localized shear stress to the stock slurry using the first turbine and applying a shear stress to the liberated stock slurry in a sufficient amount to transition the stock slurry to a non-Neutonian, Bingham-plastic fluid using the second turbine. This substantially reduces the apparent viscosity of the stock slurry and improves pumping efficiency.

37 Claims, 4 Drawing Sheets

| Stock Flow Rate | Pump Suction | T-2 O.D. | T-2 Blade Pitch | Distance T-2 to PS | T-1 O.D. | T-1 Blade Pitch | Distance T-2 to T-1 |
|---|---|---|---|---|---|---|---|
| 250T/D | 10" | 15" | 45° | 9" | 12" | 30° | 12" |
| 500T/D | 10" | 15" | 45° | 10" | 12" | 30° | 14" |
| 750T/D | 14" | 18" | 45° | 14" | 15" | 30° | 18" |
| 1200T/D | 14" | 18" | 45° | 14" | 15" | 30° | 18" |
| 1500T/D | 18" | 20" | 45° | 16" | 17" | 30° | 20" |

FIG.4

FLOW DIRECTING DEVICE FOR A MEDIUM CONSISTENCY PUMP

BACKGROUND OF THE INVENTION

1. Field of Invention

A flow directing device assists the feed of a medium to high consistency slurry through a pump by conditioning the slurry prior to pumping the slurry.

2. Description of Related Art

Pulp and paper mills universally have a major problem moving medium consistency stock (8% to 12% cellulose fibers mixed in water) and high density stock (12% to 18% cellulose fibers mixed in water) from one area of the mill to another. There are several advantages to maintaining the highest possible transport consistency. First, the end product of such mills is paper, not water. Second, mills maintain a stored inventory of stock (e.g. pulp) to run a paper machine when the pulp mill is down and stored water takes up valuable space. Third, the total tonnage of pulp that can be transferred is increased at higher pulp concentrations.

Several basic types of pumps have been used to deliver pulp through piping systems: 1) positive displacement pumps such as rotary lobe and intermeshing screw types, 2) high speed centrifugal pumps, and 3) rotary disc pumps. All of these have advantages and disadvantages.

Positive displacement pumps literally suck the pulp into the suction end and spit it out the other end. These pumps have very close tolerances that must be maintained in order for the pump to operate properly. Pulp must be clean as a small tramp solid, such as a metal staple, can jam the rotating parts, wrecking the pump. Maintenance is very high and expensive. This type of pump has the lowest power cost of operation and the highest maintenance cost of operation.

Centrifugal pumps have poor suction characteristics and depend on an inducer device, attached to the front of the impeller, to drag the medium into the impeller. This inducer creates a vortex in the suction to the pump, leading to the formation of large air bubbles that often block all flow of medium into the pump. These air bubbles must be continuously sucked out of the pump eye by a vacuum system. These pumps are popular because they greatly reduce the high maintenance costs of the positive displacement pumps. However, the unpredictable nature of vacuum systems makes reliable operation of these pumps virtually impossible. Centrifugal pumps are limited to about 12½% pulp consistency without frequent problems with bridging and clogging.

Rotary disk pumps are relatively new and have many advantages over positive displacement and centrifugal pumps. Rotary disk pumps can pass large tramp solids (up to 3" in diameter), produce no fiber damage, can pump up to 16% consistency, and have very low maintenance requirements. With adequate flow of material, such pumps are capable of handling 18+% consistency stock. However, these still have problems of their own. The major disadvantage is the lack of suction capability. That is, rotary disk pumps can only pump the material that flows into, or is pushed into, the pump. Since pulp has very little gravity flow at consistencies above 10%, this type of pump has serious problems in pumping any higher consistency. Another problem with rotary disk pumps is the "bridging" of stock above the pump suction, effectively blocking all flow into the pump. Vacuum systems have been tested on the backside of rotary disk pumps in an effort to "suck" pulp into the pump. However, this has proven to be unsuccessful.

Several devices have been produced to assist such pumps. Most are various types of inducers (Archimedes screws, beaters, augers, impellers, etc.) attached to the pump impeller shaft. These are commonly in use today to "fluidize" the stock and pull the pulp into the pump suction. However, existing devices are associated with many problems, such as mixing air into the pulp fibers, shearing the pulp fibers, and creating a pump suction vortex.

There is a need for an improved flow directing device that: 1) eliminates bridging of stock, 2) creates a non-vortexing flow, 3) is totally independent from pump operation, 4) focuses flow into the pump suction, 5) minimizes "slip/stick", 6) does not require dilution water, 7) does not mix air into the pulp fibers, 8) significantly improves the flow into the pump suction, and 9) handles entrained air up to 30%, by volume, without problems.

SUMMARY OF THE INVENTION

The invention overcomes the above and other problems by providing a low-speed, mechanical device designed for facilitating the flow of medium to high consistency pulp stock slurry into pumps. More particularly, the invention provides a flow directing device including a flow director with a two-stage turbine, a turbine shaft, a turbine mounting adapter, a gear reducer and an electric motor. The device is used with a dropleg that preferably includes a sloped bottom wall and a drain and may be retrofit to existing droplegs. The flow directing device is adapted to assist flow of medium to high consistency pulp suspensions to a pump, preferably a rotary disc pump. The flow directing device is independently operated, separate from operation of the pump. That is, startup, shutdown, rotating speed and control of the flow directing device are independent from the pump. Thus, the flow directing device's speed can be optimized to assist flow and break up bridging, which is the agglomeration of solids that can become trapped in the pumping system. The flow directing device and pump work in concert with each other to form a unique stock pumping system capable of handling paper stock consistencies from 8–18% without problems associated with other types of pumping systems.

Regardless of its physical appearance, paper stock is by definition, a slurry. Accordingly, paper stock inherently exhibits properties that consistently are associated with slurries. The total content of medium to high paper stock slurry is comprised of 8–18% pulp fibers, by weight, and 82–92% water, by weight. The normal physical characteristics and appearance of paper stock are created when water droplets are entrapped in voids and pockets within the entangled fibers. This phenomenon, also known by the technical term "freeness," pertains to the ability of stock to hold enormous quantities of water within the fiber mat. In its normal state, as the stock consistency increases, the material tends to form a semi-solid, non-flowing mass extremely difficult to pump. In order to pump paper stock slurry, the physical nature of the material must be altered by liberating a significant amount of entrapped water from the fiber mat to radically modify the nature of the material.

The first turbine (farthest from the pump) of the flow directing device is designed to condition the stock by liberating entrapped water from the fiber mat, thereby modifying its rheology. That is, the physical characteristics of the material are altered. The specific design of the first turbine, in terms of blade diameter and blade pitch, provides a localized shear stress to accomplish this change in rheology. The second turbine (closest to the pump) has a special and different diameter and blade pitch to impart shear stress to the stock. This transforms the slurry to a non Neutonian, Bingham-plastic fluid. Inherent to the transition of this state is the decrease in the apparent viscosity of the paper stock by a factor of 50%, or even greater.

Each paper stock slurry differs in consistency, fiber length, temperature, freeness, Kappa number, and other variables. Each has a specific transformation point in terms of shear stress at which it transforms to the Bingham-plastic state. The flow directing device and the pump operate in concert to accomplish and maintain this transitional, change-of-state paper stock slurry. This is achieved through precise combination of type, size, blade pitch, spacing and rotational speed of the flow directing device turbines, as well as the pump speed.

When paper stock slurry is in the modified, shear-thinned state, the flow directing device has the unique capability of delivering paper stock slurry to the suction port of the pump in required quantities and consistencies. The operating speeds of both the flow directing device and the pump can be independently adjusted to maintain indefinitely the Bingham-plastic state at a pumping rate some 500% higher than that of stock not in this transition state. This dramatically reduces the power output of motors and drives. When paper stock slurry is removed from the zone of influence of the flow directing device, the slurry gradually reverts back to its original form and state with no apparent negative effects.

The flow directing device induces a transitory state in which the nature and, therefore, physical properties of the materials exposed by the flow directing device are changed.

BRIEF DESCRIPTION OF THE DRAWINGS

The invention will be described with reference to the following drawings wherein like numerals refer to like elements and in which:

FIG. 4 shows a chart listing exemplary flow directing device parameters for various desired flow rates.

DETAILED DESCRIPTION OF PREFERRED EMBODIMENTS

Figure 1:
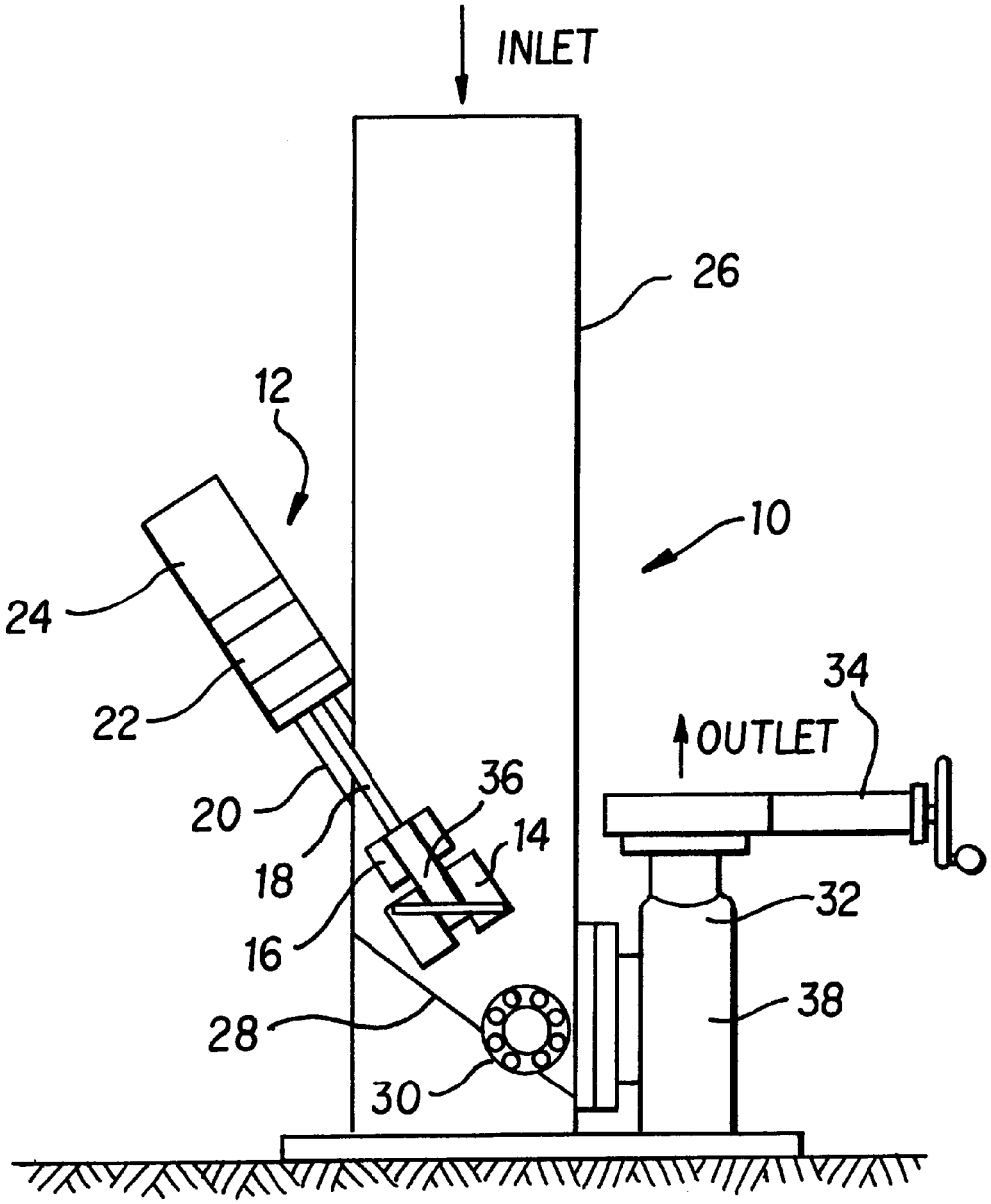
FIG. 1 shows a flow director according to a first embodiment of the invention.

In a first embodiment of the invention, shown in FIG. 1, a flow directing device 10 is shown having a flow director 12 with a second stage turbine 14, a first stage turbine 16, a common turbine shaft 18, a turbine mounting adapter 20, a gear reducer 22, and an electric motor 24 coupled to the gear reducer 22 for driving the turbine shaft 18. The device also includes a dropleg 26 (suction supply tank) at a specific angle to produce a change in direction of stock flow. Dropleg 26 preferably includes a sloped bottom wall 28 and a drain 30. The flow directing device 10 is adapted to mount onto a pump 32. Pump 32 is preferably a rotary pump, such as a Discflo rotary pump, however, various other pumps, such as centrifugal and positive displacement pumps, can realize improved operation when used in combination with the flow directing device 10 of the invention.

After a series of tests, it was determined that the best performance was achieved with a compound device having a two-stage turboprop comprising first stage upper turbine 16 and second stage lower turbine 14 having different blade sizes and mounting angles. The upper turbine 16, farthest from the pump, is preferably a low shear marine type design while the lower turbine 14, closest to the pump, is preferably a high shear marine type design. While various mounting angles and blade sizes could be used, a first exemplary configuration uses a first stage upper turbine 16 with four 3"×5" blades mounted on a center hub 36 at a pitch of 30°. The first stage upper turbine 16 is designed to supply a continuous flow of pulp to the second stage lower turbine 14. The second stage lower turbine 14 preferably includes four 3½"×8" blades mounted on the same center hub 36 at a pitch of 45°. The second stage lower turbine 14 is designed to push pulp axially into the pump suction 38, where it can be processed by the pump 32. Applicant has found that the first stage upper turbine 16 induces flow of pulp into the blades of the second stage lower turbine 14 and also prevents the formation of bridges of pulp above the pump suction 38.

The second stage lower turbine 14 takes the pulp from the first stage upper turbine 16 plus pulp from directly above the lower turbine, pushing the pulp to the bottom of dropleg 26 at a point that is preferably directly in front of the pump suction 38. The best flow was found to be achieved when the flow was directed in front of the pump suction 38 at an angle rather than directly into the pump 32 as logic may indicate. This is achieved in the first embodiment by bouncing the stream of pushed pulp off sloped bottom wall 28 of the dropleg 26 and then into the pump suction 38. The sloped wall 28 is sloped at about 30° from horizontal. However, other angles can be used and are contemplated.

The dropleg is of a special geometric design that accommodates the required angle of installation of the flow directing device, the desired flow pattern into the pump, and to provide stock retention time. The flow directing device is mounted in the dropleg at a preferred angle of 65° to the horizontal plane, although 60° has been used satisfactorily. The pump is mounted at the front of the elbow in the dropleg. For pumping rates of 250 T/D to 500 T/D a 24" dropleg can be used. For pumping rates of 750 T/D a 36" dropleg can be used. For higher flow rates, a 72" dropleg can be used.

A preferred turboprop is an MPT compound two-stage turboprop Model FD10-1130/845, which includes a 10 HP electric motor 24 driven at approximately 3450 RPM. A FALK 8:1 gear reducer 22 drops the rotation of shaft 18 to about 438 RPM. A 15 HP/460V variable frequency drive (VFD) is provided to vary the output speed of shaft 18 from about 50 to about 500 RPM. Preferably, the turboprop is installed at a 65° angle from horizontal by a 4" mounting flange, although other angles can be used depending on the application.

An exemplary pump that can be enhanced by the inventive flow director 12 is a rotary disc pump Model 804-14-2D equipped with 8" suction and 4" discharge sized for 100 gallon per minute (GPM) flow rate. This pump includes a 50 HP 1750 RPM motor and a 50 HP/460V VFD. As the flow director 12 is separate from and operates independent from the pump 32, it can be driven at an optimum rotational speed differing from the speed of the pump. Larger size pumps will produce increased flow rates up to 1000–1200 tons per day pulp production rates. In such cases, a larger capacity dropleg, as well as a larger pump, would be provided. The above-described flow director 12 was found to provide pump 32 with a continuous flow of pulp at consistencies as high as 18%. The inventive flow director also eliminates the need for a vacuum pump in higher consistencies. As such, the flow directing device 10 would also be beneficial in improving operational efficiency of centrifugal pumps.

Figure 2:
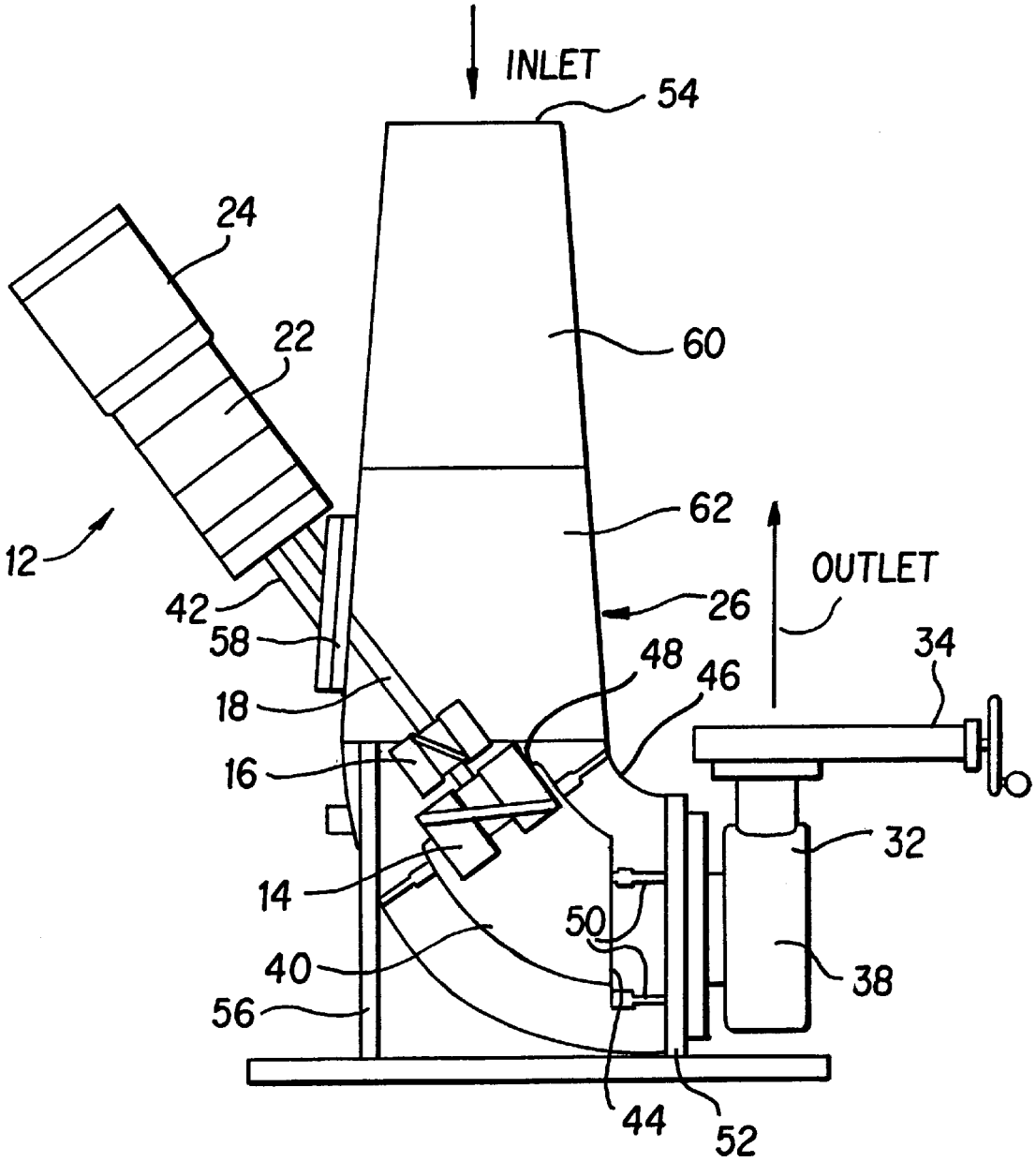
FIG. 2 shows a flow director according to a second embodiment of the invention.

In a second more preferred embodiment, illustrated in FIG. 2, the same flow director 12 is used with an improved dropleg design and the optional addition of a turbine draft tube 40. The first stage upper turbine 16 breaks up any bridges or heavy agglomerated solids that may form in the dropleg 26 above the turbines, as in the first embodiment. The second stage lower turbine 14 pushes the stock axially into the mouth of the optional draft tube 40, or in the direction of the pump suction 38 if the draft tube is not provided.

The turbine shaft 18 is cantilevered in the dropleg 26 and supports both first and second stage turbines 16, 14. A flanged turbine mounting adapter 42 is provided to allow a correct angle of entry of the turbine assembly into the dropleg. The electric motor 24 remains a 10 HP/460V motor that rotates at 3450 RPM. Gear reducer 22 reduces the input motor speed by a preferred ratio of 8:1 to produce an output turbine speed of approximately 438 RPM. The variable frequency drive VFD varies the output speed of shaft 18 from about 50 RPM to about 500 RPM so that the flow director can be adjusted to an optimum rotational speed depending on particular operating conditions.

The optional draft tube 40 preferably is provided downstream from the second stage turbine 14 and focuses the output flow from the second stage turbine 14 to the pump suction 38. A gap of about 6" between the discharge end 44 of the draft tube 40 and the pump suction 38 permits any excess flow to return between the draft tube exterior and a dropleg elbow 46 to an inlet 48 of the draft tube. The turbine and draft tube 40 have the effect of an axial flow pump. Mounting/adjustment bolts 50 precisely center the draft tube 40 around the second stage turbine 14.

A dropleg front cover 52 allows mounting of the pump suction 38 to the dropleg 26 and attachment of the mounting/adjustment bolts 50 for the discharge end 44 of the draft tube 40. Dropleg elbow 46 has a curvature and dimensions that parallel those of the draft tube 40 and permit smooth flow of stock bypassing the pump suction 38 and returning to the 48 inlet of the draft tube 40. A conical top 54 of the dropleg 26 discourages the formation of bridges by making it difficult for stock to adhere to the walls of the dropleg 26. A dropleg rear support 56 structurally supports the dropleg 26. A turbine installation port 58 allows easy installation and removal of the complete turbine assembly. A preferred dropleg has dimensions of 36"×84". The elbow 46 preferably has a 24" OD with total height and width dimensions of 36"×36", and an upper portion can be made from one or two pieces. A preferred two-piece upper dropleg includes an upper piece 60 (14'×18"×24") and a lower piece 62 (18"×24"×24'). The flow tube 40 preferably has a 12" inner diameter with 6" standoffs. However, these dimensions obviously can vary depending on the particular pump used and its operating parameters.

Figure 3:
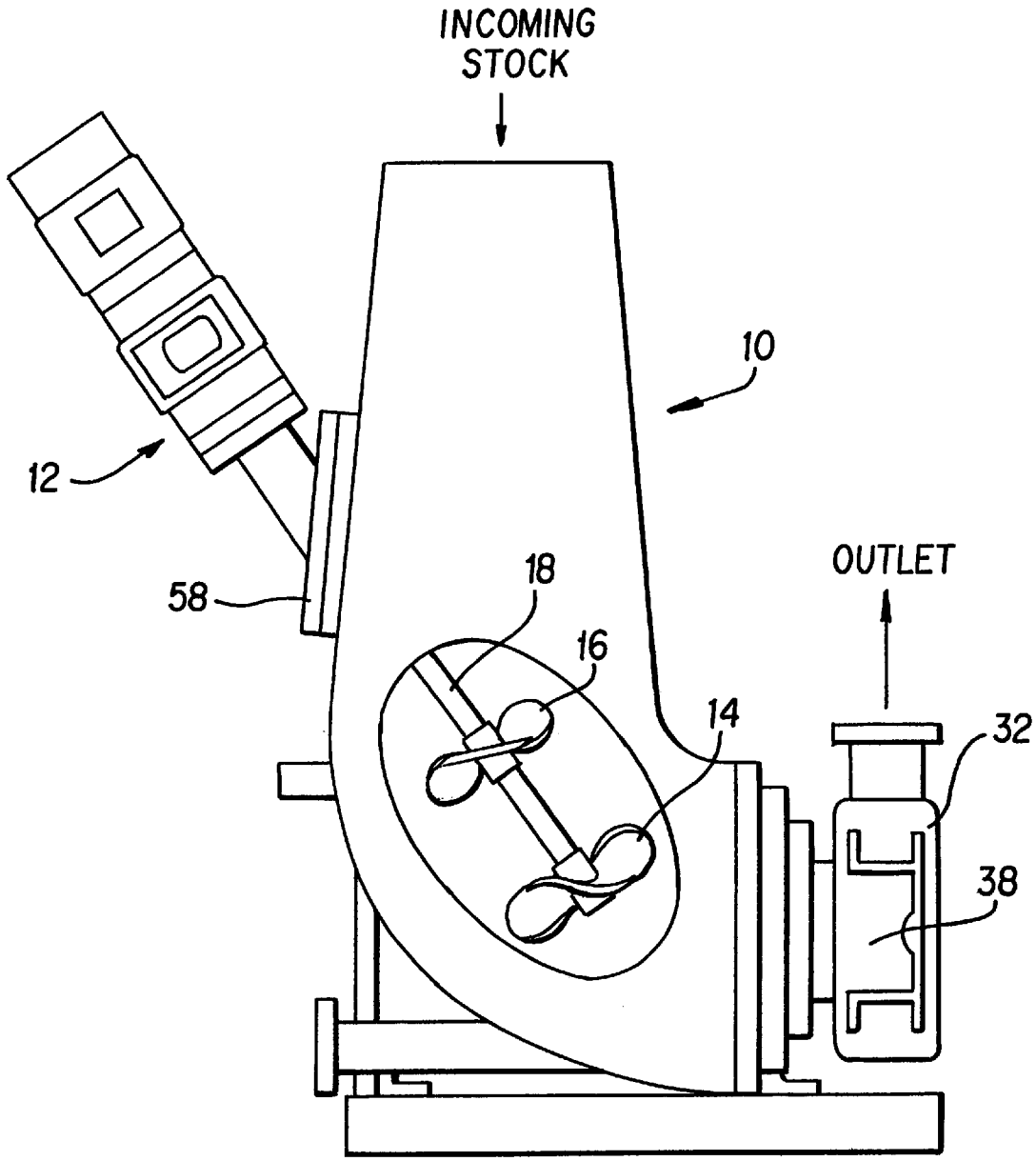
FIG. 3 shows a flow director according to a third embodiment of the invention.

A third even more preferred embodiment is shown in FIG. 3. Lower turbine 14 is located 14" from the pump suction. The upper turbine 16 is located 10" from lower turbine 14. The upper turbine 16 is a marine-type, three blade turbine with a 13" diameter. The three individual blades are straight, rounded at the end, and welded to the hub of the turbine at an angle of 30°. The upper turbine 16 prevents stock bridging in the dropleg and pre-conditions the stock slurry by changing its rheology and pushing the stock to the lower turbine.

The lower turbine 14 is a weedless marine-type having three blades and a 15" diameter. The three individual blades are curved on either side, rounded at the ends and installed on the hub at a basic angle of 45°. Lower turbine 14 is designed to push the stock slurry axially, and to impart a high level of shear stress to the stock slurry to change its rheology to a Bingham-plastic state.

Dropleg 26 is preferably constructed of stainless steel and has a geometric design that accommodates the installation and operation of the flow director 12. The flow director 12 is installed at an angle of 65° from horizontal. The curved section at the discharge end of dropleg 26 enables the flow director 12 to push stock slurry at the optimum attack angle in regards to the pump suction. The dropleg 26 as tested had a maximum diameter of 24" with a conical top having a reduced diameter of 20". This reduction prevents the stock slurry from building up on the sidewalls of the dropleg. A 36" dropleg could be substituted, with the entire system scaled up proportionally.

The flow directing device 10 in this embodiment can handle up to 750 tons/day of 8%–18% stock at up to 200' TDH with no water dilution, no air removal system and up to 50% entrained air. To achieve this, the flow director 12 is made from a two-stage turboprop Model FD25-18/15 driven by a 25 HP/460V/1750 RPM motor and a Euro gear reducer that reduces output speed of the shaft to 250 RPM. A 30 HP/460V/150 Hz variable frequency drive (VFD) is provided to vary the output speed of shaft 18. The flow director 12 can be mounted on an ANSI 20" flange.

The pump is preferably a rotary disc pump Model 1408-2D-20 having a 14" suction and a 8" discharge. This pump has a 200 HP/460V/150 RPM motor with a 200 HP/460V variable frequency drive.

Additional embodiments of the invention are described in FIG. 4, which shows various relationships between the flow rates, pump suction size, turbine diameters, turbine blade pitch, and distances between pump suction and the two turbines for achieving different stock flow rates.

In FIG. 4, Stock Flow rate refers to tons of bone-dry stock per day. Pump Suction is the minimum diameter of the pump suction opening. T-2 O.D. is the maximum diameter of turbine 2 (lower turbine). T-2 Blade Pitch is the installed angle of the individual blades of turbine 2. T-1 O.D. is the maximum diameter of turbine 1 (upper turbine). T-1 Blade Pitch is the installed angle of the individual blades of turbine 1. Distance T-2 to PS is the minimum distance from turbine 2 to the pump suction. Distance T-2 to T-1 is the minimum distance between the two turbines.

Actual test have been conducted to established preferred variables up to 750 T/D flow rates. Higher flow rates are believed to follow the basic relationship of the lower flow rate values and have been interpolated.

Several advantage are achieved by the flow directing device of the invention. A common problem with other devices is that they cut a hole through heavy stock and the flow of stock stops until there is a buildup of sufficient stock above the bridge that causes the bridge to collapse. However, with the inventive flow directing device, the first stage turbine 16 scoops a cut out of the flowing stock plug, creating a stress line at the plug center, and continuously collapsing the stock onto the second stage turbine 14.

Most inducer devices create a vortex that produces a large air bubble in the pump suction, which can result in an airlock that shuts off all flow. However, with the invention, the second stage turbine 14 pushes the stock axially through the draft tube 40, or without the draft tube in the direction of the pump suction.

The inventive flow director operates completely independent from pump operation. The flow director's speed can be adjusted to an optimal speed to assist the flow of stock into the pump suction. Tests have shown that a speed as low as 30 RPM is sufficient for 8–12% stock and 200–300 RPM for stock above 14–15% consistency.

The inventive flow director can be retrofitted into old droplegs where installation of a draft tube may be difficult or impractical. However, it is preferred to use the optional draft tube as it provides a tremendous improvement in operational efficiency when pumping certain types of stock slurry. The draft tube is most beneficial at consistencies above 14% with excess flow returning between the draft tube exterior and the dropleg elbow. Below 12% stock, flow through the draft tube is minimal and the primary flow of stock is outside of the draft tube and into the pump suction. However, at any consistency, the draft tube maintains a positive continuous flow of stock to the pump suction. In certain types of stock, the flow directing device may operate better without the draft tube.

A slip/stick phenomenon can occur when heavy stock moves from the pump through a discharge pipe several inches and seems to grab the pipe wall and stick momentarily before it slips a few more inches. This problem is common to all medium consistency pumps and becomes increasingly apparent as the stock increases in consistency above 8%. However, with the inventive flow director, the flow director rotational speed can be adjusted up or down to minimize or eliminate "slip/stick."

Competitive pumping systems for medium consistency pumps all require dilution water, part time or full time, in order to pump the stock. Some of these available systems require dilution of the stock below 12% consistency. Prior flow inducer devices do not compensate for the pump's inability to handle heavy stock. However, the inventive flow director provides a positive assist to flow of stock into the pump, eliminating the need for dilution water.

Many flow inducer devices beat and whip the stock violently to fluidize the stock and produce better flow of pulp into the pump. However, this intimately mixes air into the pulp fibers, creating a problem by blocking chemical treatment agents in certain bleaching processes. These devices also introduce high shear rates that damage the pulp fibers. However, with the inventive flow director, stock is pushed into the pump suction without mixing, maintaining the integrity of entrained air bubbles with no mixing of air with the pulp fibers. The gentle pushing action of the flow director is low shear, minimizing any pulp fiber damage.

The inventive system also requires no entrained air or gas removal system to pump paper stock slurries at consistencies to 18%.

The unique pushing action of the inventive flow directing device system does not effect the distribution and size of entrained gas or air bubbles in the paper stock slurry and does not produce intimate mixing of air and pulp fibers. This is an important consideration when chemical treatment of pulp fibers takes place downstream of the pumping system.

The inventive flow directing device also produces a physical change in paper stock slurry, transforming the slurry to a Bingham-plastic state, with a resultant substantial drop in apparent viscosity.

After discharging from the pump discharge, the paper stock slurry transforms to a "plug flow" in the discharge pipe. The higher density of the stock and the pulp fiber entanglement squeezes the pockets of entrained air to the outside of the plug and against the pipe wall. The air becomes a lubricating film to the stock plug, reducing pipe friction and, subsequently, the horsepower required to move the stock through the piping system.

The inventive flow directing device also enhances pump suction conditions by improving the pulp rheology and increasing the net positive suction head (NPSH) available to the pump. These factors reduce the tendency of the pump to cavitate at reduced static suction head. As little of 24" of static suction head above the upper turbine is sufficient to operate the system.

The gentle pushing action and slow operational speed of the flow directing device pushes stock into the pump suction with low turbulence. This minimizes any damage to pulp fibers.

The flow directing device is capable of pumping entrained tramp solids up to 3" O.D. or up to 6" in length. This includes undigested knots and wood chips, rocks, bullets and nails, pieces of wire, plastic or metal strapping, and bolts and nuts, to mention a few items. These are commonly associated with paper stock slurry produced from trees or waste paper products, as well as incidental items that fall into the stock during the various processing steps.

By having an upper turbine that is a low shear device, the tendency for the stock to bridge is minimized in the suction leg while continuously pushing stock to the lower turbine.

While primarily designed to assist pumping paper stock slurries, the inventive flow directing device can provide assistance to any pump for other difficult to pump slurries.

Although the invention has been described in detail above with reference to several embodiments, various modifications can be implemented without departing from the spirit and scope of the invention.

What is claimed is:

1. A flow directing device for assisting feeding of a medium to high consistency material in a downstream flow direction through a pumping system, comprising:

a turbine shaft;

a motor coupled to the turbine shaft for driving of the turbine shaft at a predetermined speed;

a first turbine having a low shear blade configuration and a first diameter, the first turbine being mounted intermediate the shaft;

a second turbine having a high shear blade configuration and a second diameter larger than the first diameter, the second turbine being mounted near an end of the turbine shaft opposite the motor, a predetermined spacing being provided between the first turbine and the second turbine; and a mounting adapter that mounts the flow directing device to a pipe in a pumping system with the second turbine facing in the downstream direction.

2. The flow directing device of claim 1, wherein a blade pitch of the first turbine is about 30°.

3. The flow directing device of claim 1, wherein a blade pitch of the second turbine is about 45°.

4. The flow directing device of claim 1, wherein the spacing is substantially equal to a diameter of a pump suction opening of a pump located downstream in the pumping system.

5. The flow directing device of claim 1, wherein the flow directing device is provided with a variable frequency drive to allow varying of the desired speed.

6. The flow directing device of claim 5, wherein the desired speed is between 30 to 500 RPM.

7. A pumping system for pumping medium to high consistency material, comprising:

an inlet pipe having an upstream end and a downstream end, the inlet pipe receiving a supply of medium to high consistency material;

a flow directing device including a turbine shaft, a motor coupled to the turbine shaft for driving the turbine shaft at a predetermined speed, a first turbine blade having a low shear blade configuration and a first diameter, the first turbine being mounted intermediate the shaft, a second turbine having a high shear blade configuration and a second diameter larger than the first diameter, the second turbine being mounted near an end of the turbine shaft opposite the motor, a predetermined spacing being provided between the first turbine and the second turbine, and a mounting adapter that mounts the flow directing device to the inlet pipe so that the first turbine and the second turbine are within the inlet pipe, wherein the first turbine is located toward the upstream end and the second turbine is located toward the downstream end.

8. The pumping system of claim 7, further comprising a pump having a pump suction inlet of a predetermined diameter located at the downstream end of the inlet pipe, the pump being operable at a predetermined pumping speed.

9. The pumping system of claim 8, wherein the second turbine is located a predetermined distance from the pump suction inlet.

10. The pumping system of claim 8, wherein the pumping speed and the turbine speed are individually set and controlled.

11. The pumping system of claim 8, wherein the pump is a rotary disk pump.

12. The pumping device of claim 8, further comprising a draft tube sized to encircle the second turbine and extend toward the pump suction inlet.

13. The pumping system of claim 7, wherein the first turbine has a blade pitch of about 30°.

14. The pumping system of claim 7, wherein the second turbine has a blade pitch of about 45°.

15. The pumping system of claim 7, wherein the flow directing device includes a variable frequency drive to vary the desired speed of the turbine shaft.

16. The pumping device of claim 7, wherein the inlet pipe is a dropleg.

17. The pumping device of claim 16, wherein the dropleg has an elbow and the turbine shaft is located in the elbow at an angle relative to horizontal.

18. The pumping device of claim 17, wherein the angle is between 60–65°.

19. The pumping device of claim 16, Wherein the dropleg includes a sloped bottom wall.

20. The pumping device of claim 7, wherein the pumping system operates on material having 8–18% solids content.

21. A pumping system for pumping medium to high consistency material, comprising:

an inlet pipe having an upstream end and a downstream end, the inlet pipe receiving a supply of medium to high consistency material;

a flow directing device including a turbine shaft, a motor coupled to the turbine shaft for driving the turbine shaft at a predetermined speed, a first turbine blade having a low shear blade configuration, the first turbine being mounted intermediate the shaft, a second turbine having a high shear blade configuration, the second turbine being mounted near an end of the turbine shaft opposite the motor, a predetermined spacing being provided between the first turbine and the second turbine, and a mounting adapter that mounts the flow directing device to the inlet pipe so that the first turbine and the second turbine are within the inlet pipe, wherein the first turbine is located toward the upstream end and the second turbine is located toward the downstream end and the material is a pulp slurry and the first turbine conditions the slurry by liberating entrapped water from the pulp.

22. The pumping system of claim 21, wherein the second turbine imparts a shear stress sufficient to transform the slurry to a non-Neutonian, Bingham-plastic fluid.

23. The pumping system of claim 22, further comprising a pump having a pump suction inlet of a predetermined diameter located at the downstream end of the inlet pipe, the pump being operable at a predetermined pumping speed, wherein a spacing between the pump suction inlet and the second turbine is approximately the same as the diameter of the pump suction inlet.

24. A method of efficiently flowing a medium to high consistency stock slurry in a pumping system, comprising:

introducing a supply of medium to high consistency stock slurry to an inlet pipe having an upstream end and a downstream end;

directing the slurry through at least one of a first turbine having a low shear blade configuration and a second turbine having a high shear blade configuration, the second turbine being located downstream of the first turbine in the flow direction;

driving the first and second turbines at a predetermined turbine speed;

liberating liquid from the stock slurry by providing a localized shear stress to the stock slurry using the first turbine and pushing the stock slurry toward the downstream end of the inlet tube; and applying a shear stress to the liberated stock slurry in a sufficient amount to transition the stock slurry to a non-Neutonian, Bingham-plastic fluid using the second turbine and pushing the stock slurry further toward the downstream end of the inlet pipe.

25. The method of claim 24, further comprising the steps of introducing the stock slurry into a pump having a pump suction inlet at the downstream end of the inlet tube.

26. The method of claim 25, further comprising the step of pumping the stock slurry in a non-Neutonian Bingham-plastic fluid state, from the second turbine through the pump.

27. The method of claim 26, further comprising the step of operating the pump at a predetermined pumping speed.

28. The method of claim 27, wherein the pumping speed and the turbine speed are independently set and controlled.

29. The method of claim 28, wherein the turbine speed is adjustable between 30 to 500 RPM.

30. The method of claim 26, wherein the second turbine is located a predetermined distance from the pump suction inlet.

31. The method of claim 30, wherein the predetermined distance is approximately the same as a diameter of the pump suction inlet.

32. The method of claim 26, further comprising the step of positioning a draft tube downstream from the second turbine and spaced from the pump suction inlet.

33. The method of claim 25, wherein the pump is a rotary disc pump.

34. The method of claim 24, wherein the step of liberating liquid from the stock slurry is achieved by providing the first turbine with a blade pitch of approximately 45° and rotating the first turbine at the turbine speed.

35. The method of claim 24, wherein the step of applying a shear stress to the liberated stock slurry sufficient to transition the stock slurry to a non-Neutonian, Bingham-plastic fluid is achieved by providing the second turbine with a blade pitch of approximately 30° and rotating the second turbine at the turbine speed.

36. The method of claim 24, further comprising configuring the inlet pipe as a dropleg and mounting the flow directing device within the dropleg at an angle relative to horizontal.

37. The method of claim 36, wherein the angle is between 60–65°.

* * * * *